United States Patent [19]

McMurray

[11] Patent Number: 4,846,757

[45] Date of Patent: Jul. 11, 1989

[54] FORM CHANGING RUBBER-LIKE TOY

[76] Inventor: Larry D. McMurray, 14421 29th Ave. S., Seattle, Wash. 98168

[21] Appl. No.: 136,780

[22] Filed: Dec. 22, 1987

[51] Int. Cl.[4] ..... A63H 33/00

[52] U.S. Cl. ..... 446/486; 446/373; 446/385; 446/491

[58] Field of Search ..... 446/370, 371, 373, 374, 446/385, 386, 388, 486, 490, 491; 400/701, 702; 434/82, 83, 216

[56] References Cited

U.S. PATENT DOCUMENTS

| | | | |
|---|---|---|---|
| 1,629,862 | 5/1925 | Faber | 400/702 X |
| 2,545,210 | 3/1951 | Moore | 434/82 X |
| 2,830,402 | 4/1958 | Schleich | 446/385 |
| 3,505,699 | 4/1970 | Trumbull | 400/702 X |
| 4,674,981 | 6/1987 | LaPadura | 434/82 |

*Primary Examiner*—Robert A. Hafer
*Assistant Examiner*—Charles H. Harris
*Attorney, Agent, or Firm*—Mark Zovko

[57] ABSTRACT

A novelty item or toy for use by young children. The invention provides a predetermined amount of conventional kneaded rubber type cleaner and a rubber band. The rubber band and kneaded rubber are mixed together and appropriately kneaded to form a single mass. When the rubber band within the mass is first twisted and then allowed to unwind, the mass formed by the kneaded rubber and rubber band changes to surprising and curious shapes as the rubber band unwinds.

1 Claim, 1 Drawing Sheet

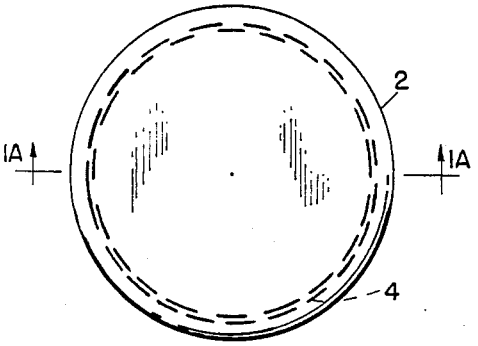
FIG. 1
FIG. 1A
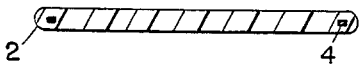
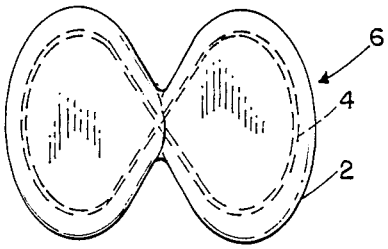
FIG. 2
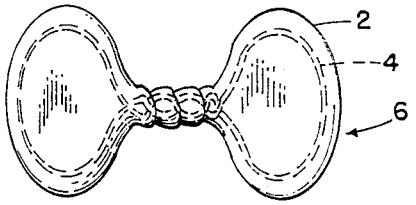
FIG. 3
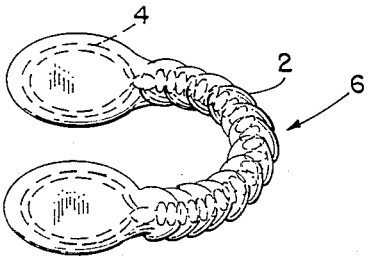
FIG. 4
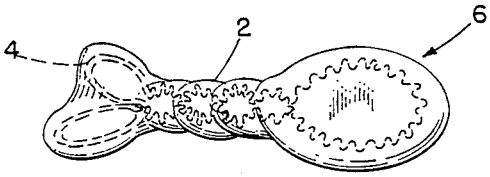
FIG. 5

FORM CHANGING RUBBER-LIKE TOY

BACKGROUND OF THE INVENTION

This invention relates in general to shape changing toys for children, and in particular to a novel toy which apparently changes form by itself after manipulation to produce surprising and interesting shapes.

In recent years, many novelty items for children have been produced which emphasize what can be called the children's fascination with items colloquially referred to as "gross". Many toys have grotesque forms or shapes which seem to presently appeal to a large percentage of modern youngsters. The present invention provides a unique combination of two well known elements; a common rubber band and conventional kneaded rubber type cleaner. When these two items are combined, the resulting mass can provide much entertainment for the young if the rubber band within is twisted and allowed to unwind. "Gross" shapes of the mass result in a fascinating manner, apparently with no outside cause, as the kneaded rubber type cleaner retards or resists the unwinding of the rubber band while adhering in part of the rubber band producing in the vernacular, a lump of moving "crud". Although many toys of a "gross" nature exist in the market, and certainly the rubber band and kneaded rubber type cleaner are conventional, applicant believes that the combination of the two produces a unique and novel toy for children.

SUMMARY OF THE INVENTION

The invention is a novelty item or toy which forms surprising and interesting shapes when left alone apparently on its own accord. The toy is comprised of a conventional rubber band a predetermined amount of kneaded rubber type cleaner. These two items are mixed together to form a unitary mass, and when the rubber band within the mass is first twisted and then allowed to unwind, the mass formed by the kneaded rubber type cleaner and rubber band changes to surprising and interesting forms as the rubber band unwinds.

It is therefore an object of the present invention to provide a safe, non-toxic toy or novelty item which can provide entertainment and fascination for children.

Another object of the present invention is to provide a unique, somewhat surprising toy which apparently moves on its own accord.

A further object of the present invention is to provide an inexpensive toy which has fascination and charm for children.

Another object of the present invention is to provide a toy in which the user can present a relatively simple toy to an observer and yet the observer will have great difficulty in determining the mechanism involved in the toy's operation regardless of the observer's background and intelligence. In other words, e.g., a three year child can challenge the intelligence of an educated adult.

Yet another object is to provide a toy which can be used over and over by a small child with no maintenance.

Another object of the present invention is to provide a toy which gives the user and observer the sense that it is "alive."

These and other objects and advantages will become apparent from the following description when taken in conjunction with the drawings.

BRIEF DESCRIPTION OF THE FIGURES

FIG. 1 shows a cross sectional view of a wad of kneaded rubber type cleaner having a rubber band embedded therein.

FIG. 1A is a cross-sectional view of the kneaded rubber type cleaner and rubber band of FIG. 1 taken through line A—A of FIG. 1.

FIG. 2 is a cross-sectional view of the kneaded rubber type cleaner and rubber band of FIG. 1 as the mass is twisted.

FIG. 3 is a cross-sectional view of the kneaded rubber type cleaner and rubber band of FIG. 2 after further twisting of the mass.

FIG. 4 is another cross-sectional view of the kneaded rubber type cleaner and rubber band of FIG. 3 afer still further twisting of the mass.

FIG. 5 is another cross sectional view of the kneaded rubber type cleaner and rubber band of FIG. 4 after yet further twisting of the mass.

DESCRIPTION OF THE PREFERRED EMBODIMENT

Referring to the FIGS. 1 through 5, the invention can be produced by taking the first component, conventional kneaded rubber type cleaner designated as 2, e.g. "STAR" kneaded rubber type cleaner by Eberhard Faber, Inc. and kneading that type cleaner until it is somewhat softened. The resulting wad of kneaded rubber will have a consistency similar to molding clay although slightly more resilient. A conventional rubber band 4 can then be intermingled or mixed with the kneaded rubber type cleaner forms a unitary mass 6; this unitary mass is kneaded to form a lump. The amount of type cleaner to mix with a given size rubber band can vary, although enough type cleaner should be used so that the unitary mass is smooth prior to twisting the rubber band. It is also suggested that the rubber band chosen have sufficient strength to move the adhering type cleaner as the rubber band unwinds. If the rubber band is too weak, the type cleaner will resist its uncoiling so much that little or no movement occurs.

To operate the toy, simply twist the mass formed by the type cleaner and rubber band so that the rubber band begins coiling as shown sequentially in FIGS. 2 through 5. When sufficient coiling occurs as determined by the user, the mass can be placed down and will produce varying shapes and forms as the type cleaner resists the uncoiling of the rubber band while adhering thereto. Usually, texture and shape changes occur until the rubber band is once again at rest. Of course, the unitary mass can then be re-formed into a lump and twisted again to repeat the process. Many children can find amusement and fascination watching the mass move "by itself."

Of course, minor variations of this idea may occur in both form and substance, and the invention herein disclosed is intended to be that as claimed in the enclosed claim including all embodiments which come within the equivalency of claims doctrine.

What I claim is:

1. A toy comprising a rubber band and a predetermined amount of kneaded rubber type cleaner, which forms a unitary mass, said kneaded rubber type cleaner is wrapped around said rubber band, thereby enclosing said rubber band within the volume of said unitary mass, so that when said rubber band within said unitary mass is twisted and allowed to unwind, said unitary mass changes in form as said rubber band unwinds.

* * * * *